US008240452B2

(12) United States Patent
Fischer et al.

(10) Patent No.: US 8,240,452 B2
(45) Date of Patent: Aug. 14, 2012

(54) TREAD ELEMENTS FOR A CONVEYOR AND METHOD AND DEVICE FOR TESTING TREAD ELEMENT STRIPS

(75) Inventors: August Fischer, Ebenfurth (AT); Gerhard Lunardi, Wiener Neudorf (AT); Michael Matheisl, Vösendorf (AT); Wolfgang Neszmerak, Vienna (AT)

(73) Assignee: Inventio AG, Hergiswil NW (CH)

( * ) Notice: Subject to any disclaimer, the term of this patent is extended or adjusted under 35 U.S.C. 154(b) by 92 days.

(21) Appl. No.: 12/669,232

(22) PCT Filed: Jul. 14, 2008

(86) PCT No.: PCT/EP2008/059193

§ 371 (c)(1), (2), (4) Date: Aug. 19, 2010

(87) PCT Pub. No.: WO2009/010495

PCT Pub. Date: Jan. 22, 2009

(65) Prior Publication Data

US 2010/0320058 A1 Dec. 23, 2010

(30) Foreign Application Priority Data

Jul. 16, 2007 (EP) ..... 07112516

(51) Int. Cl.
*B65B 23/12* (2006.01)

(52) U.S. Cl. ..... 198/333

(58) Field of Classification Search ..... 198/332, 198/333

See application file for complete search history.

(56) References Cited

U.S. PATENT DOCUMENTS

| | | | | | |
|---|---|---|---|---|---|
| 4,413,719 | A | * | 11/1983 | White | 198/333 |
| 4,858,745 | A | * | 8/1989 | Haas et al. | 198/333 |
| 4,984,672 | A | * | 1/1991 | Saito et al. | 198/333 |
| 5,337,879 | A | * | 8/1994 | Fischer | 198/333 |
| 5,441,140 | A | * | 8/1995 | Reid | 198/333 |
| 6,213,278 | B1 | * | 4/2001 | Tanigawa | 198/333 |
| 6,283,270 | B1 | * | 9/2001 | Robibero et al. | 198/333 |
| 6,398,003 | B1 | * | 6/2002 | Jasinetzky | 198/333 |
| 6,978,876 | B1 | * | 12/2005 | Tsukahara et al. | 198/333 |
| 7,204,361 | B2 | * | 4/2007 | Illedits | 198/326 |
| 7,264,105 | B2 | * | 9/2007 | Illedits | 198/326 |

FOREIGN PATENT DOCUMENTS

| | | |
|---|---|---|
| DE | 21 61 442 | 7/1972 |
| DE | 299 09 808 | 9/1999 |
| DE | 198 50 847 | 5/2000 |
| EP | 1 116 681 | 7/2001 |

* cited by examiner

*Primary Examiner* — Douglas Hess
(74) *Attorney, Agent, or Firm* — Ladas & Parry LLP

(57) ABSTRACT

A tread element for a conveyor such as an escalator or moving sidewalk has a tread plate and at least one border strip. First and second abutment arrangement for the strip are provided, and include a first groove element and a tongue element on mating portions of the tread plate and strip. Interacting stop surfaces of the abutment arrangements on the plate and strip prevent relative movement in the direction of mounting, while one of the abutment arrangements provides a locking arrangement between the tread element and strip.

13 Claims, 8 Drawing Sheets

TREAD ELEMENTS FOR A CONVEYOR AND METHOD AND DEVICE FOR TESTING TREAD ELEMENT STRIPS

The invention relates to a tread element for a conveyer, a method of checking tread element strips and a test device for carrying out the method.

By conveyors in the sense of the present invention there are to be understood endless conveyors such as moving walkways and escalators having a plurality of interconnected tread elements.

Escalators have a tread plate and a riser part for each tread element and in the case of the respective escalator part in use or usable the tread plate is disposed in horizontal arrangement and the riser part substantially in vertical arrangement. Moving walkways usually have only tread plates, which in the case of the respective part of the moving walkway in use or usable can be horizontal or slightly inclined in transport direction.

Conveyors of this kind are constructed so that they are usable at least in one forward direction of travel.

The tread plates and optionally the riser parts can be provided with strips which usually extend along the edge regions of the tread plates or along a part of these edge regions. In principle, such strips can, however, be attached everywhere. The strips serve, in particular, as a safety device in order to protect the users of conveyors from stepping on risk areas, for example areas in which two tread plates abut or on lateral edge regions of the tread plates. The marking of such risk areas can be carried out by coats of paint on the tread plates and optionally on the riser parts, but such coats of paint frequently peel off after a short period of time, for which reason the strips are to be preferred.

Conventionally, such strips, which can consist, for example, of a suitable metallic material or a suitable plastics material, are fixed to the tread elements with the help of additional fastening elements such as, for example, screws and thus with use of suitable tools. A fastening of that kind is costly in every respect.

Whereas the tread elements are usually aluminium castings, the strips can be made of a suitable plastics material. In general, the strips are in this connection made with lower dimensional accuracy or greater tolerances than the tread elements. In addition, the gap widths between the mounted strip and the tread element have to be made of such a size that problem-free compensation is provided in operation for the differential thermal expansion of the plastics material strip and the aluminium tread element. This can have the consequence that the strips after mounting thereof on the tread elements have from adjacent parts of the conveyor a spacing which departs to such an extent from a desired spacing that a proper and safe functioning of the conveyor is no longer guaranteed. The mentioned adjacent parts can be adjacent strips and/or adjacent parts of the tread elements and/or stationary parts of the conveyor. A proper functioning of the conveyor can, for example, be impaired if an excessively wide gap arises in which dirt collects or in which pieces of clothing or luggage of users of the conveyor can be caught.

It is the object of the invention

- to create an improved tread element with a strip, wherein the strip is to be able to produced simply and positioned precisely without substantial effort and, in particular, solidly mounted without additional fastening elements and—as far as possible—free of tools; as well as
- to propose a method of checking strip parts with respect to dimensional accuracy and mechanical strength, and
- a device for performance of this method.

According to the invention this object is fulfilled by the features of the independent claims; preferred developments are outlined by dependent claims.

Advantageously, according to the invention a strip can be mounted at the tread element without additional fastening elements, thus, for example, without screws, and as far as possible free of tools. In addition, the removal thereof can be managed without special tools, wherein in a given case account is to be taken of the fact that the strips are not demountable free of destruction.

The strips and the tread elements are so constructed that movements of the strip, always seen relative to the tread element, (i) transversely to the travel directions, (ii) perpendicularly away from the tread surface and (iii) in the travel directions are entirely prevented or at least limited to a very small amount of play.

The mutual connection of the strips with the tread plates or with the riser parts is carried out similarly to key/groove connections or with the help of co-operating or complementary elements, wherein in each instance one element is arranged at a fastening surface of the tread element and the other element at the strip.

The strips substantially consist of a strip body and of different projections, which serve for fastening of the strips, at the strip body. Groove projections are provided at the surface, which faces the fastening surface of the tread element, of the strip. In principle, a groove projection (also termed groove body) is so formed that together with the strip body it bounds a groove. In the mounted state a key engages in this groove. This key is arranged at the fastening surface of the tread element, i.e. at the surface of the tread plate when the strip is to be fastened to the tread plate or at the outer surface of the riser part when the strip is to be fastened to the riser part.

The just-described form of fastening, however, indicates only the basic principle of the fastening. In particular, the groove projection is usually so constructed at the strip that it forms not only one, but two groove bodies and two grooves, which are accessible from opposite sides, wherein in the case of such an arrangement the fastening surface of the tread element has in complementary manner two keys. In addition, several such key/groove arrangements can be present at a strip. Depending on the respective arrangement of the strip these key/groove arrangements can be arranged in parallel or in alignment.

The grooves of the strip and the associated keys of the tread element are so arranged that the keys project substantially parallelly to the tread surface or parallelly to the outer surface of the riser part. The free ends of the groove body thereby engage under the keys.

The key for a groove is, as already explained, arranged at the respective fastening surface of the tread element, i.e. at the surface of the tread plate or at the outer surface of the riser part. Not only the groove, but also the key have defined lengths. The fastening surface has, adjoining a longitudinal end of the key, an opening into which the groove projection of the strip body can be introduced perpendicularly to the fastening surface during a first mounting step. In a succeeding mounting step the strip is so pushed parallel to the fastening surface that the key engages in the groove. The previously described constructional elements of the key/groove connection serve the purpose of preventing displacement of the strip perpendicularly away from the fastening surface of the tread element.

The groove body has boundary surfaces which are oriented substantially perpendicularly to the fastening surfaces. The boundary surfaces, which lead during the second mounting step, of the groove body form strip abutment surfaces which co-operate in the mounted state with tread element abutment surfaces, which are arranged adjacent to that longitudinal end of the keys which is opposite the opening. It is thus prevented that the strips displace forwardly to a certain extent in push-in direction of the groove/key arrangement and, in particular, in the direction of the second mounting step.

The strip body has, in addition to the groove projections, one or more locking projections which are arranged at the same surface as the groove projections. In the mounted state of the strip these locking projections engage in complementary locking recesses of the tread plate or the riser part. These locking projections and the locking openings are so arranged that they prevent a displacement of the strip against the push-in direction (against the direction of the second mounting step), thus to a certain extent rearwardly.

The strip body is resiliently deformable. Whilst, during mounting, groove projections or groove bodies are guided by way of the keys (during the second mounting step), the strip body is so resiliently deformable in the region of the locking projections that the locking projections can slide over the fastening surface into the locking openings. At the final location of the mounting of the strip the locking projection of the strip can engage in the locking opening of the tread element so that the strip body relaxes again by itself and deforms to its original shape. The strip abutments of both the groove projections and the locking projections then bear against the corresponding tread element abutments.

In the above-described key/groove arrangement the keys are arranged at the tread element and the grooves and groove bodies at the strip. However, a converse arrangement is also possible in which the keys are arranged at the strip and the grooves and groove bodies at the tread element.

The tread surfaces of the tread plates and the outer surfaces of the risers usually have integral projections extending in transport direction and separated by flutes and the surface of the strip should be designed so that these said integral flutes and projections have an aligned or supplementing continuation in flutes and projections of the strip.

As mentioned further above, the strip is usually subdivided into several, namely at least two, strip parts. These strip parts can, for example, be arranged with mirror symmetry with respect to a vertical centre plane, which extends in transport direction of the conveyors, of the tread element.

The strip or the strip parts can, for example, be arranged exclusively in the edge region of the tread plate opposite the edge or they can be arranged at several edge regions.

The strip parts can also be constructed as angle strips with two limbs. In a case of each angle strip the first limb can be arranged as a transverse limb along the edge region of the tread plate opposite the edge and the second limb as a longitudinal limb along an edge of the tread plate extending in travel direction.

The strip can also be so arranged that it marks a separation of the tread plate into two regions, particularly a lefthand and righthand part in travel direction, in order to call to mind to users the principle of 'stand on the right, walk on the left'.

It is also possible to arrange, in the case of moving stairways, strips or strip parts only or additionally at the outer surface of the riser.

It has proved advantageous to make the resiliently deformable strips or strip parts from a suitable plastics material, wherein the projections at the strip are preferably produced integrally with the strip.

The strip or the strip parts is or are preferably so constructed with respect to the properties thereof, namely with respect to the material, shape and dimensions thereof, that it or they form bodies which can resiliently deform, in a given case also manually. The arrangement of the groove projections and the locking projections at the strip body is such that the strip body is resiliently deformed or biased so that the mounting process is made possible. When the strip or the strip part is disposed at the definitive location (when the locking projection is disposed at the place of the locking opening) then the bias can be removed. In order to guarantee a solid, shake-free fixing of the strip or the part strip it can be worthy of recommendation to merely reduce the bias. A securing of the strip or the strip part by means of the key/groove arrangement and the co-operating abutment surfaces can be achieved in this manner.

The strips or strip parts and, in particular, the projections or groove bodies at the strips are to be easily deformable, which on the one hand is necessary for the intended mounting and which on the other hand can provide compensation for inaccuracies in production.

As already mentioned, the strips or strip parts should be so arranged that their flutes and projections are approximately aligned with the flutes and projections of the tread surfaces at which they are mounted. It is also particularly important to maintain desired spacings of the strips or strip parts from adjacent parts of the conveyor so that excessive gaps are avoided. For this purpose the strips or strip parts are checked by means of the new method and the new test device.

In the new method for checking the strips or strip parts the strips or strip parts are temporarily arranged on a test device. Reference locations, i.e. references lines or reference points, of the strips of strip parts are then measured in order to determine which actual values of spacings would result during the mounting. Deviations of the actual values of this measurement from the predeterminable target values are then ascertained. Finally, the strips or strip parts are released for mounting at the tread elements with the condition that the deviations of the actual values from the target values lie within defined tolerance ranges.

The invention is described in explanatory manner in the following by way of a preferred exemplifying embodiment and with reference to the drawing. In this connection, merely a moving stairway and the tread elements thereof inclusive of the strips are described, but the invention also relates to tread elements of moving walkways. In all figures the same or similar constructional elements are provided with the same reference numerals and, in order to ensure clarity of the figures, not all reference numerals were inserted in each figure. In the drawing.

Figure 1:
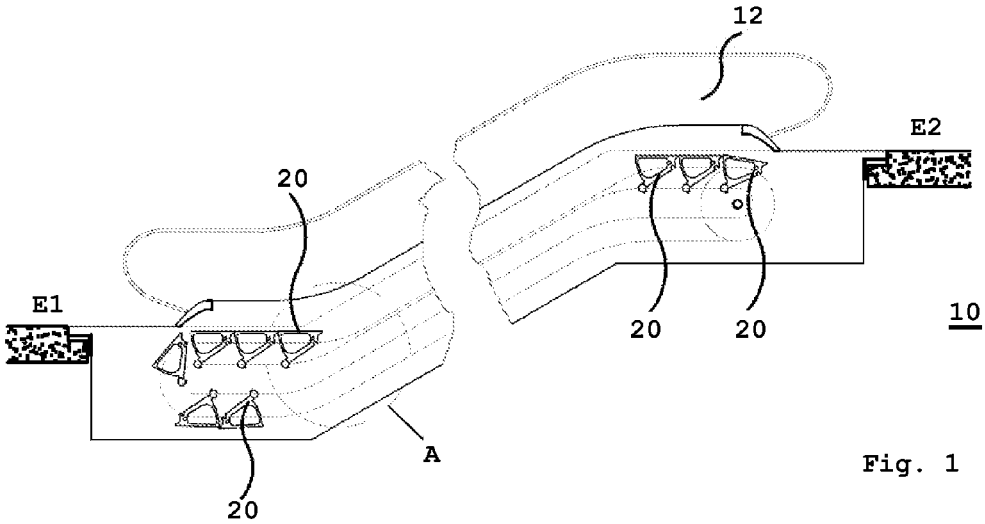
FIG. 1 shows a moving stairway, from the side and partly sectioned, in substantially simplified illustration.

The conveyor shown in FIG. 1 is a moving stairway, which is equally denoted by 10 and which leads from a lower plane E1 to an upper plane E2. Lateral balustrades 12 bound the moving stairway 10. Moreover, the moving stairway 10 comprises a plurality of tread elements 20 which are connected together.

Figure 2A:
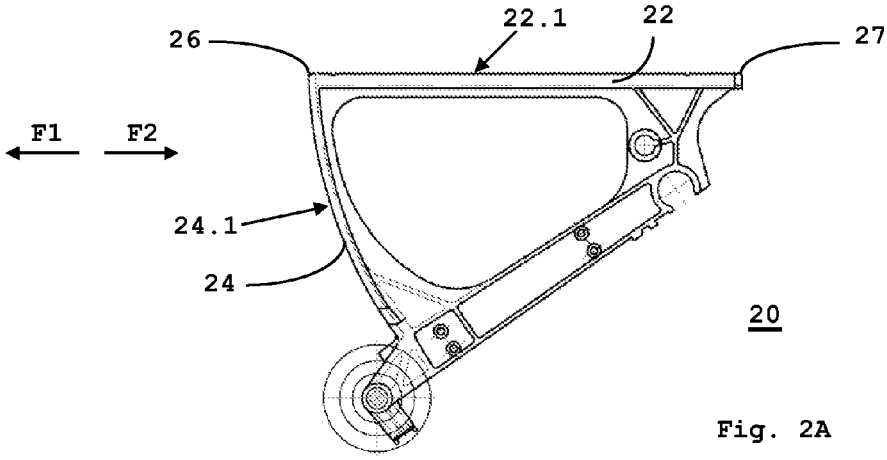
FIG. 2A shows a tread element, but without strips, of the moving stairway shown in FIG. 1, from the side and partly sectioned.

FIG. 2A shows a detail A of FIG. 1, namely substantially one of the tread elements 20. The tread element 20 comprises a tread plate 22 with a tread surface 22.1 and a riser part 24 with an outer surface 24.1 of the riser. In the respectively usable part of the moving stairway 10 the tread surfaces 22.1 of each tread plate 22 are arranged at least approximately horizontally and the outer riser surfaces 24.1 of the risers 24 approximately vertically. The tread plate 22 and the riser part 24 meet one another, wherein the tread surface 22.1 and the outer surface 24.1 form an edge 26, which appears in FIG. 2A as a point and which runs perpendicularly to the travel directions of the escalator 10, i.e. perpendicularly to the upward travel direction F2 and to the downward travel direction F1.

Figure 2B:
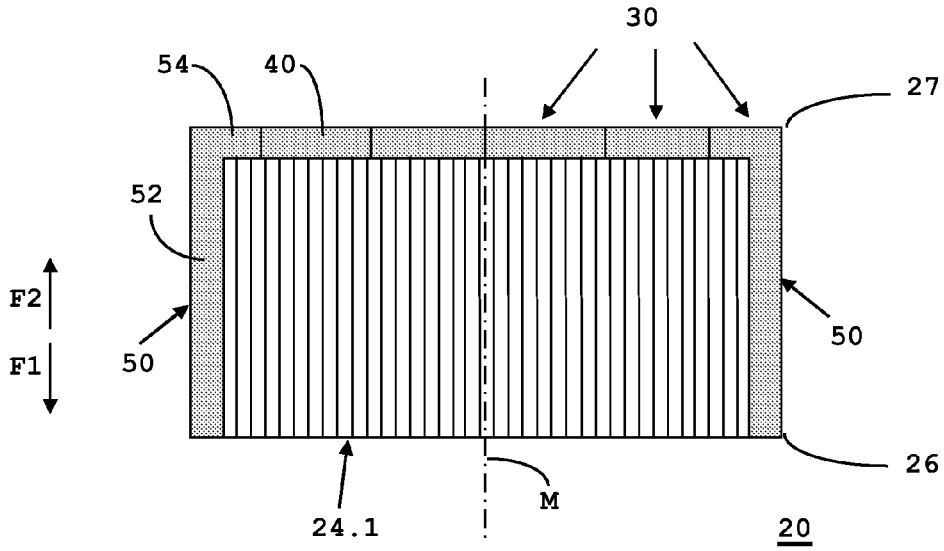
FIG. 2B shows a tread element like the tread element shown in FIG. 2A, with several strips, in simplified illustration, from above.
Figure 3B:
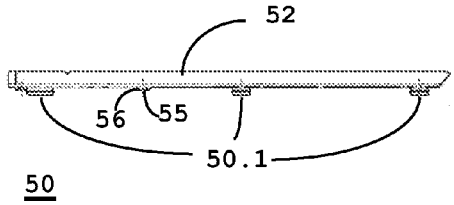
FIG. 3B shows the angle strip shown in FIG. 3A, from the side.
Figure 3C:
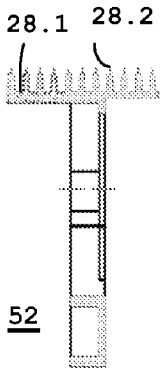
FIG. 3C shows the angle element shown in FIGS. 3A and 3B, as seen in travel direction.

As indicated in FIG. 2B and shown more precisely in FIG. 3C, the tread surface 22.1 and the outer surface 24.1 of the riser part 24 have projections 28.2 running in the travel directions F1, F2 and separated by flutes 28.1. Each second projection of the tread surface 22.1 impinges on a projection of the outer surface 24.1 of the riser part 24.

If the usable part of the escalator 10 moves in travel direction F2 and thus upwardly to the plane E2, then from the tread plate 22 an edge region 27, which lies parallelly opposite the edge 26, leads, as illustrated in FIG. 2B. If the usable part of the escalator 10 moves in travel direction F1 and thus downwardly to the plane E1, then from the tread plate 22 the edge 26 leads, as similarly apparent from FIG. 2B.

A vertical centre plane of the moving stairway 10 is denoted by M in FIG. 2B.

FIG. 2B additionally shows a strip 30. This strip 30 comprises a plurality of strip parts, namely four transverse strips 40 and two angle strips 50.

All transverse strips 40 are either of the same construction with respect to one another or they are substantially diametrically opposed or of mirror symmetry, particularly with respect to the centre plane M.

The angle strips 50 comprises a first angle strip, on the left in FIG. 2B, and a second angle strip, on the right in FIG. 2B. The two angle strips 50 are constructed and arranged substantially diametrically opposed with respect to the centre plane M, but they can be different in details, particularly with respect to their flutes 28.1 and projections 28.2, which supplement corresponding flutes and projections of the tread plate. Each angle strip 50 has a first limb or longitudinal limb 52, which in the present example extends longitudinally of side edges of the tread surface 22.1 of the tread element 20. Each angle strip 50 also has a second limb or transverse limb 54. This transverse limb 54 here has, as seen in travel direction F1, F2, the same dimensions as the transverse strips 40 and is arranged in alignment with the transverse strips 40.

Figure 2C:
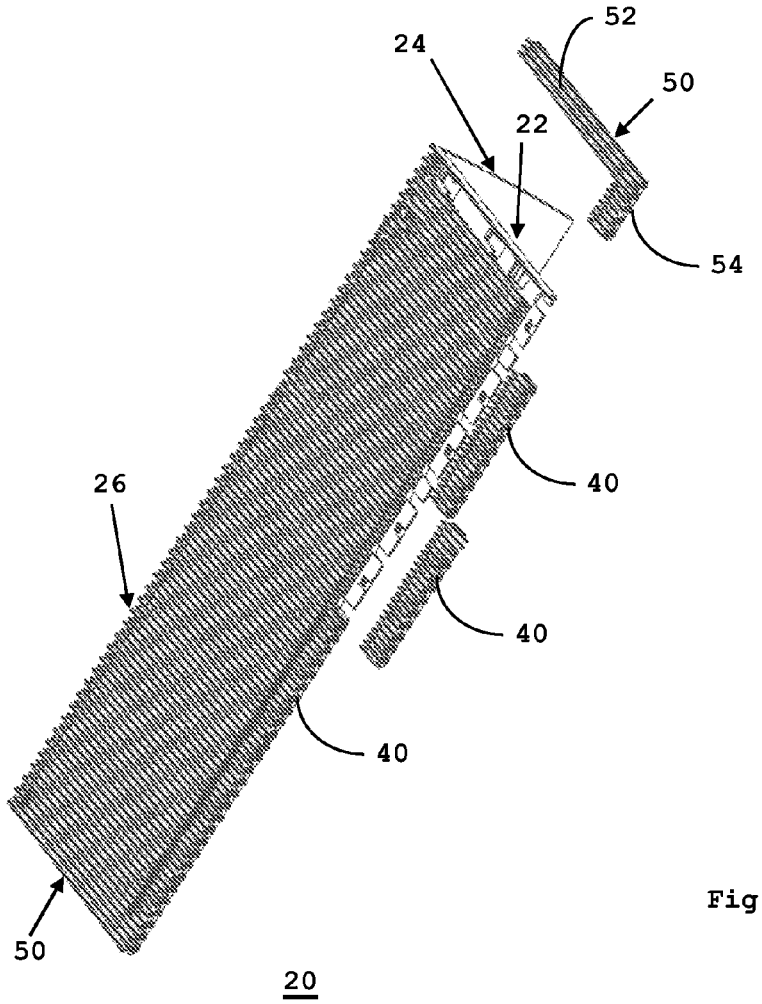
FIG. 2C shows the tread element shown in FIG. 2B, with strips, in a schematic view.

FIG. 2C schematically shows the tread element 20, wherein one of the angle strips 50 and some of the transverse strips 40 are mounted, whilst the other angle strips 50 and two transverse strips 40 are ready for mounting.

Figure 3A:
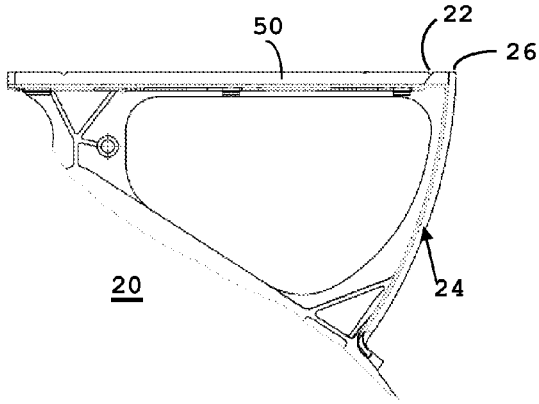
FIG. 3A shows a tread element with an angle strip, from the side and partly sectioned.
Figure 3D:
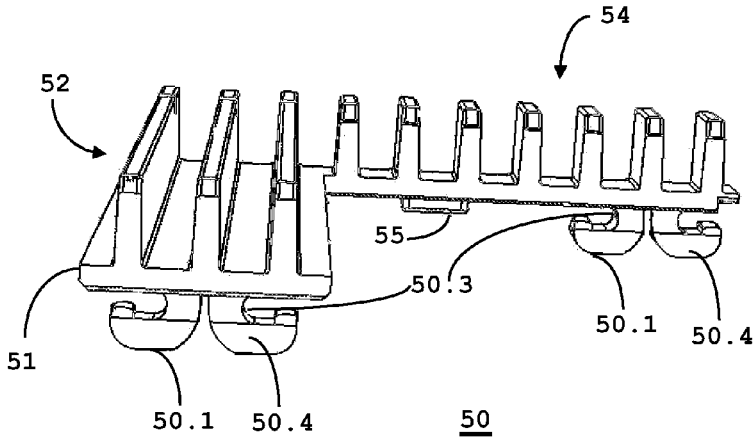
FIG. 3D shows the angle element shown in FIGS. 3A, 3B and 3C, in a schematic view.

FIG. 3A shows the tread element 20 with one of the angle strips 50 in a vertical section. The angle strip 50 has the longitudinal limb 52 and the transverse limb 54 and is shown separately in FIGS. 3B, 3C and 3D. The angle strip 50 possesses a strip body 51 in the form of an L. The longitudinal limb 52 has several groove projections 50.1 or groove bodies 50.1, of which in each instance two groove bodies 50.1 are approximately diametrically opposed and form a pair. Two such pairs of groove bodies 50.1 are arranged in alignment one behind the other in travel direction F1 or F2, wherein only one of these pairs is visible in FIG. 3D. The transverse limb 54 has a pair of groove bodies 50.1. Each groove body 50.1 forms a groove 50.3.

A key 200 of the tread plate 22 engages in each of the grooves 50.3 in the mounted state, as this is described further below with reference to FIGS. 6A and 6B. The grooves 50.3 respectively arranged in pairs and the keys 200 similarly arranged in pairs extend parallel to the tread surface 22.1 of the tread plate 22 at the tread element 20 and in travel direction F1, F2. Strip abutment surfaces 50.4 are present at the one longitudinal ends of the groove bodies 50.1. In the mounted state, these strip abutment surfaces 50.4 bear against complimentary tread plate abutment surfaces 250.1 at the end of the keys 200.

Figure 4A:
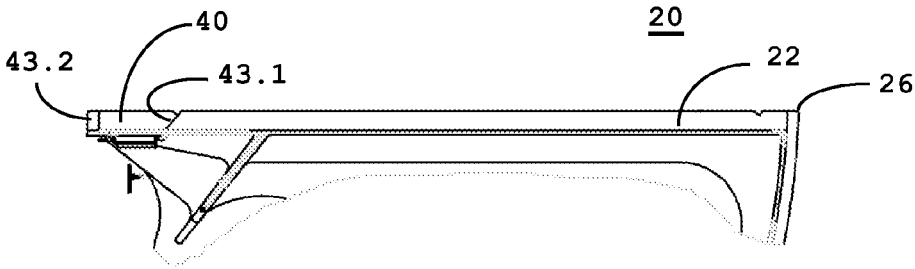
FIG. 4A shows a tread element with a transverse strip, in the manner of a detail and in the same illustration as FIG. 3A.
Figure 4B:
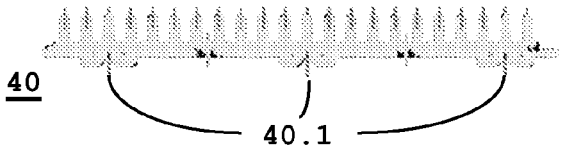
FIG. 4B shows the transverse strip of the tread element shown in FIG. 4A, as seen in travel direction.
Figure 4C:
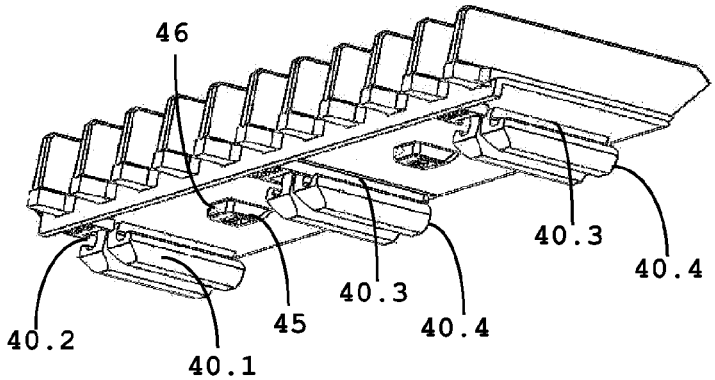
FIG. 4C shows the transverse strip shown in FIG. 4B, in a schematic view.
Figure 5B:
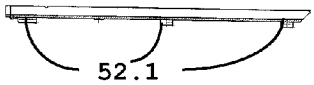
FIG. 5B shows the angle strip of the tread element shown in FIG. 5A.
Figure 5D:
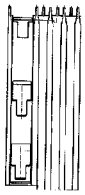
FIG. 5D shows the angle strip shown in FIG. 5A in a section.
Figure 5F:
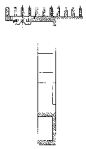
FIG. 5F shows a longitudinal limb in section.
Figure 5A:
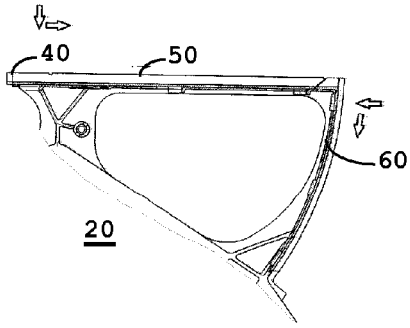
FIG. 5A shows a tread element which has additional edge strips at the riser part, from the side and partly sectioned.
Figure 5C:
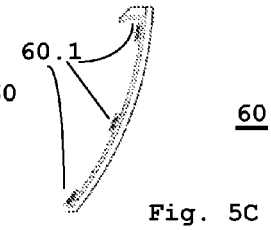
FIG. 5C shows the edge strip (of the riser) of the tread element shown in FIG. 5A, from the side.
Figure 5E:
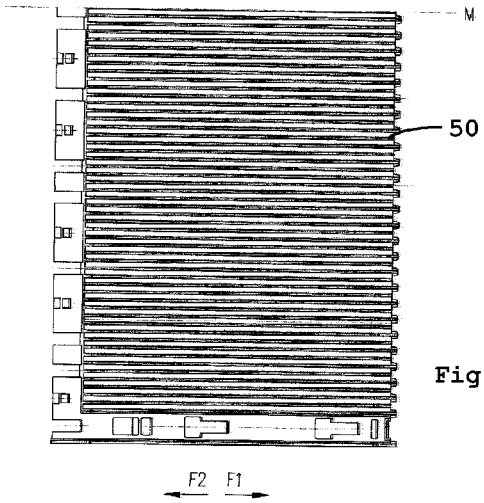
FIG. 5E shows a half of the tread element in a plan view.

FIG. 4A shows the tread step 20 with one of the transverse strips 40 in a vertical section. The transverse strip 40 itself is shown separately in FIGS. 4B and 4C. The transverse strip 40 has groove projections or groove bodies 40.1. These groove bodies 40.1 lie, as seen in travel direction F1 or F2, adjacent to one another and form grooves 40.3. The groove bodies 40.1 and thus also the grooves 40.3 are arranged in pairs and, within a pair, at least approximately in mirror image. As shown in FIGS. 6A and 6B, further keys 200, which are similarly arranged in pairs, engage in the grooves 40.3 of the transverse strip 40. The one ends of the groove bodies 40.1 of the transverse strip 40 have strip abutment surfaces 40.4. In the mounted state, these strip abutment surfaces 40.4 bear against complementary tread plate abutment surfaces 240.1 at the end of the keys 200.

A variant of a tread element 20 is shown in FIGS. 5A to 5D, in which not only are edge strips 60 mounted along two lateral edge regions of the riser part 24, but also, as described above, transverse strips 40 and angle strips 50 are mounted along three edge regions of the tread plate 22. As a result, in total five strip types are employed, namely a pair of angle strips 50 as well as several transverse strips 40 at the tread plate 22, and a pair of substantially diametrically opposed edge strips 60 at the riser part 24. The edge strips 60 have groove projections or groove bodies 60.1, which form grooves. These groove bodies 60.1 and grooves are of substantially the same form as those of the angle strips 50 and the transverse strips 40. In particular, strip abutment surfaces are present at the one longitudinal ends of the groove body 60.1.

The strip parts, i.e. the transverse strips 40 and the angle strips 50 for the tread plate 22 (as well as, in a given case, the edge strips 60 for the riser part 20), are additionally furnished with blocking projections 45 and 55, respectively, which have strip abutment surfaces 46 and 56, respectively. These strip abutment surfaces 46, 56 face in the opposition direction to the strip abutment surfaces 40.4, 50.4 of the groove bodies 40.1, 50.1 of the corresponding strip parts 40 or 50. In the mounted state of the strip parts 40, 50 the strip abutment surfaces 46, 56 bear against corresponding tread element abutment surfaces 240 or 250 in recesses of the tread plate 22.

Figure 6A:
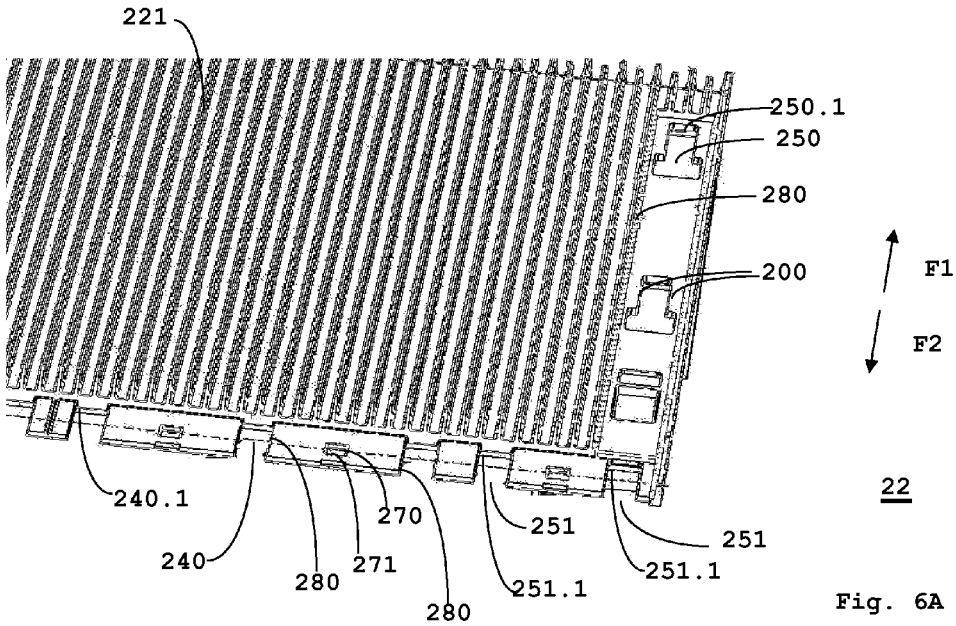
FIG. 6A shows a tread element, in the manner of a detail, with a view on the tread surface, in a schematic view.
Figure 6B:
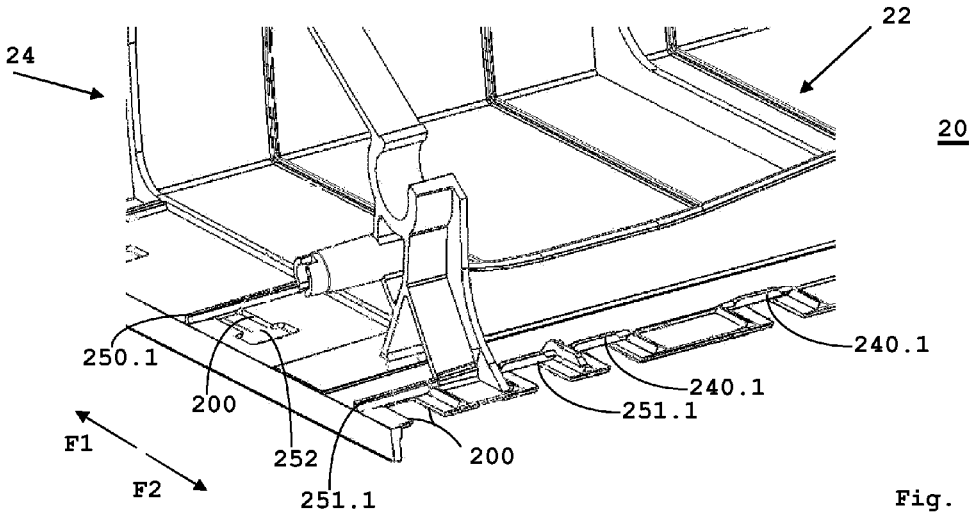
FIG. 6B shows the tread element shown in FIG. 6A, with a view onto the tread plate from below, in a schematic view.

FIG. 6A shows the tread plate 22 with a view onto the tread surface 22.1, i.e. onto the fastening surface for the transverse strips 40 and the angle strips 50. FIG. 6B shows the tread element 20 from below, wherein, in particular, the tread plate 22 is clearly illustrated. The tread plate 22 has elongate recesses 240, 250, 251. The recesses 250 and 251 are mounting recesses with the lateral keys 200 for the angle strip 50. The recesses 240 are mounting recesses with the lateral keys 200 for the transverse strips 40. The recesses 250 are bounded on all sides by material of the tread plate 22.2. The recesses 251 and 240 are open at a side or towards the side opposite the edge 26 of the tread plate 22.

The elongate keys 200, which are arranged in pairs in parallel to the travel directions F1, F2, are formed at the lateral edges of the recesses 250, 251, 240, as already described. The keys 200 are significantly less resilient than the grooves 40.3, 50.3 of the strip parts 40, 50, in which they engage in the mounted state, and can be described as almost rigid.

Those groove bodies 40.1 and 50.1 of the strips 40 and 50, in the grooves 40.3 and 50.3, respectively, of which the keys 200 of the recesses 240 and 251 engage, could be readily pushed into the corresponding recesses 240 and 251, respectively, open at the entrance. However, the groove bodies 50.1 of the longitudinal limbs 52 are introduced into recesses 250 edged at all sides, for which reason these recesses 250 have widened openings 252 at the ends thereof facing the edge 27.

All keys 200 prevent lifting of the strip 30 or strip parts 40, 50 from the tread plate 22.

The recesses 240, 251, 250 have at the one ends thereof the tread plate abutment surfaces 240.1, 251.1, 250.1, against which the complementary strip abutment surfaces bear in the mounted state. The strip parts 40 and 50 are thereby secured against further displacement in mounting direction or push-in direction, coincident in FIG. 6A with the travel direction F1.

The tread plate 22 additionally has locking recesses 270. The locking projections 45, 55 of the strip parts 40, 50 engage therein in the mounted state. The locking recesses 270 have, for this purpose, tread plate abutment surfaces 271 against which the complementary strip abutment surfaces bear in the mounted state. In this manner the strip parts 40, 50 are secured against displacement in the direction opposite to the mounting direction or push-in direction, coincident in FIG. 1 with the travel direction F2.

Finally, the tread plate 22 has lateral abutment surfaces 280 in order to secure the strip parts 40, 50 against displacement parallel to the tread surface 22.1 and perpendicularly to the travel directions F1, F2.

Everything which was previously described and is further described in the following with respect to the construction, mounting and definitive arrangement of the transverse strips 40 and angle strips 50 for the tread plate 22 also analogously applies to the edge strips 60 of the riser part 24.

The mounting of the strips 30 or the strip parts 40, 50 is carried out basically in the manner of a snap-locking with use of the resilience of the strip bodies, in accordance with the schematic illustration in FIGS. 7A to 7D.

Figure 7A:
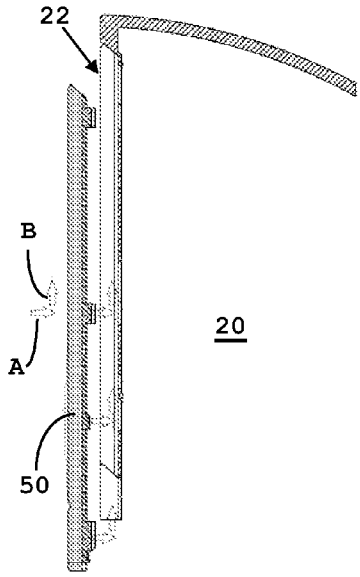
FIG. 7A shows the mounting process of an angle strip at a tread element according to FIG. 3A.

FIG. 7A shows a mounting process for an angle strip 50 at a tread plate 22, wherein arrows A and B substantially indicate the successive relative movements of the angle strip 50 relative to the tread plate 22 during the mounting process.

Figure 7B:
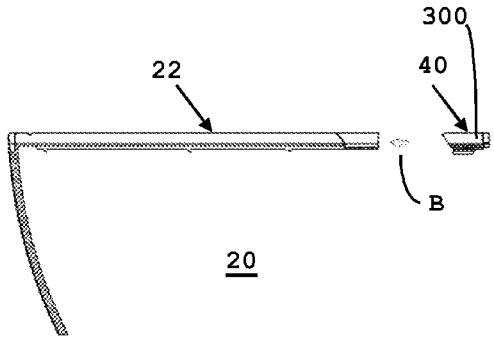
FIG. 7B shows the mounting process of a transverse strip at a tread element according to FIG. 4B.
Figure 7C:
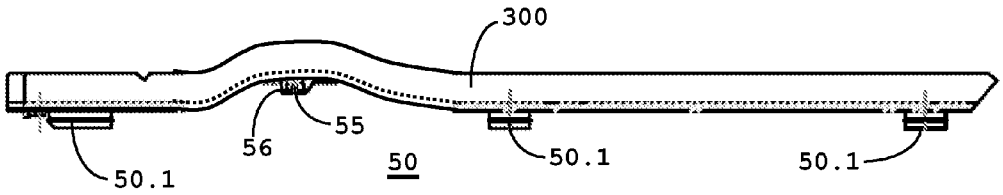
FIG. 7C shows an angle strip as deformed in the mounting process.

FIG. 7C shows the angle strip 50, which is resiliently deformed for the mounting process, with the groove projections 50.1 and with the locking projection 55.

FIG. 7B shows a mounting process for a transverse strip 40 at a tread plate 22, wherein an arrow B indicates the relative movement of the transverse strip 40 relative to the tread plate 22 during the mounting process.

Figure 7D:
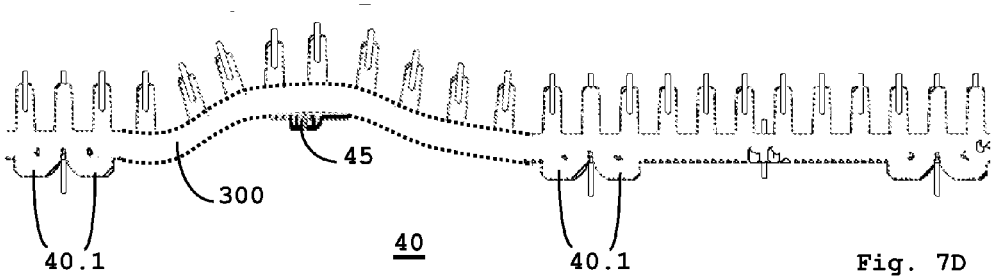
FIG. 7D shows a transverse strip as deformed in the mounting process.

FIG. 7D shows the transverse strip 40, which is resiliently deformed for the mounting process, with the groove projections 40.1 and the locking projection 45.

The maintenance of specific gap sizes and the accuracy of the strip parts 40, 50 60 employed is of enormous importance, since in the case of excessive gap dimensions jamming of clothing or pieces of luggage can occur, which can lead to accidents in the use of the conveyors.

It is also of great importance to secure the strips 30 or the strip parts 40, 50, 60 against a so-called pulling-out from the tread element 20. In particular, the angle strips 50 and the transverse strips 40 have to be secured against pulling-out from the tread plate 22.

According to the invention, therefore, an appropriate method of testing the strip parts is proposed. This method is performed on a special test device and serves the purpose of separating suitable strip parts, which adhere to predetermined standards and can be passed for mounting, from other strip parts which due to deficient dimensional accuracy or strength may not be released for mounting.

According to the test method the following method steps are executed for testing the dimensions of the strips:

- arranging in each instance a strip part temporarily at a test fixing arrangement of the test device,
- measuring the strip part at reference locations,
- determining a deviation of an actual dimension from a target dimension, and
- releasing the strip part for mounting at the tread element if the deviation lies within a predeterminable tolerance range of the dimensions.

In these method steps the target dimension can be determined at the same tread element perpendicularly to the travel direction and in travel direction of the conveyor and/or determination of the deviation is carried out with respect to a further strip part. However, the deviation can also be determined with respect to a part adjacent to a stationary part of the conveyor 10. The reference locations can be disposed at those surfaces of the strips which, in the mounted state, face the tread element.

Figure 8A:
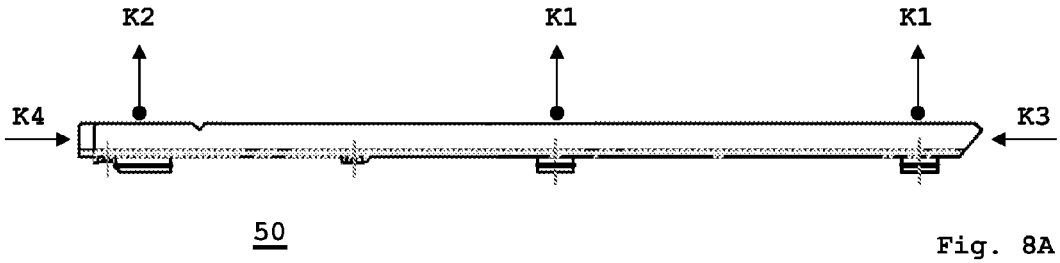
FIG. 8A shows an angle strip with the test forces of the test method.
Figure 8B:
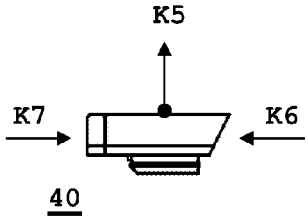
FIG. 8B shows a transverse strip with the test forces of the test method.

According to the test method the following method steps are carried out for testing the strength or the resistance of the strips against the mentioned pulling out:

- arranging a finished strip part temporarily at a test fixing arrangement of the test device.
- applying test forces K1 to K7 to the strip parts, according to FIGS. 8A and 8B, wherein the test forces are higher than the maximum assumed pulling-out forces which, in operation, act on the strip parts
in mounting direction
opposite to the mounting direction
perpendicularly away from the tread surface releasing the strip part for mounting at the tread element if the strip parts do not pull out under the test forces.

The test device according to the invention is designed for performing the stated method and comprises a test fixing arrangement having elements which act in the same manner as the corresponding elements of a tread step. The test device enables temporary fastening of the strip parts, rapid and reliable measuring of the deviation or deviations of the measurements and rapid and reliable application of the test forces.

The invention claimed is:

1. A tread element for a conveyor movable in at least one travel direction which tread element comprises a tread plate with a tread surface and a strip at least one region of the tread surface, wherein a guiding and fixing arrangement with a first element in the form of a groove and with a second element in the form of a key engaging the groove is provided, wherein one of the elements is provided at the tread plate and the other of the elements is provided on the strip and the two elements co-operate in order to prevent movements of the strip relative to the tread element perpendicularly away from the tread surface, characterized in that a first abutment arrangement is provided, with first tread element abutment surfaces at the tread plate and complementary first strip abutment surfaces at forward ends of groove projections of the strip, the first abutment arrangement providing guidance for the for the connection between the tread plate and strip and not providing a locking function between the tread plate and strip, a second abutment arrangement is provided, with a second tread element abutment surface at the tread element and a second strip abutment surface at a locking projection of the strip, the second abutment arrangement providing a locking function between the tread plate and strip, wherein the first and the second abutment arrangements are spaced laterally from each other, engage through relative motion of the strip in a plane parallel to the tread surface, and each is oriented and arranged to prevent movements of the strip relative to the tread element, and the strip has a resiliently deformable strip body for bending during mounting such that the strip abutment surfaces thereof come into contact with the respectively complementary tread plate abutment surfaces.

2. A tread element according to claim 1, characterized in that a third abutment arrangement is provided, with third, lateral tread element abutment surfaces on the tread element and third strip abutment surfaces at the strip oriented and arranged to prevent movements of the strip relative to the tread element perpendicularly to the mounting direction and parallel to the tread plate.

3. A tread element according to claim 2, characterized in that the first strip abutment surface and/or the third strip abutment surface is or are arranged at a groove projection of the strip part.

4. A tread element according to claim 1 or 2, characterized in that the strip comprises a plurality of strip parts.

5. A tread element according to claim 4, wherein the conveyor is an escalator and the tread element has a riser part, characterized in that at least one further strip part, preferably an edge strip, is arranged at the riser part.

6. A tread element according to claim 1 or 2, characterized in that the key is arranged at the tread element and the groove projections with the grooves are arranged at the strip.

7. A tread element according to claim 1 or 2, characterized in that a strip is arranged at an edge region, which extends perpendicularly to a travel direction of the tread surface.

8. A tread element according to claim 1 or 2, characterized in that the strip comprises at least two strip parts at least approximately diametrically opposed with respect to a vertical center plane extending in a travel direction of the tread surface.

9. A tread element according to claim 8, characterized in that the strip parts are constructed as angle strips with two limbs, wherein a first limb is a longitudinal limb and arranged substantially in the travel direction and a second limb is a transverse limb and formed perpendicularly to the travel direction.

10. A tread element according to claim 9, characterized in that the strip part extends particularly in the travel direction substantially along the entire tread plate.

11. A tread element according to claim 9, characterized in that one of the strip parts extends substantially in the travel direction over a limited region of the tread element.

12. A tread element according to claim 1 or 2, characterized in that the key extends over a limited region of the tread element,
is bounded by the first tread plate abutment surface and
has an opening widened transversely to a longitudinal direction of the groove and forms a passage for the groove body.

13. A tread element according to claim 1 or 2, characterized in that the second strip abutment surface is arranged at a locking projection of the strip part.

* * * * *